US008234970B2

(12) United States Patent
Barillas

(10) Patent No.: US 8,234,970 B2
(45) **Date of Patent: *Aug. 7, 2012**

(54) GASKET, COVER WITH GASKET, AND PNEUMATIC CYLINDER WITH COVER AND GASKET

(75) Inventor: Gonzalo Barillas, Alsfeld-Altenburg (DE)

(73) Assignee: Carl Freudenberg KG, Weinheim (DE)

( * ) Notice: Subject to any disclaimer, the term of this patent is extended or adjusted under 35 U.S.C. 154(b) by 20 days.

This patent is subject to a terminal disclaimer.

(21) Appl. No.: 12/958,859

(22) Filed: Dec. 2, 2010

(65) Prior Publication Data

US 2011/0074114 A1 Mar. 31, 2011

Related U.S. Application Data

(63) Continuation of application No. 11/982,158, filed on Nov. 1, 2007, now Pat. No. 7,866,252.

(30) Foreign Application Priority Data

Nov. 3, 2006 (EP) ..... 06022912

(51) Int. Cl.
*F15B 15/22* (2006.01)
*F15B 15/00* (2006.01)

(52) U.S. Cl. ..... 91/405; 91/394

(58) Field of Classification Search ..... 91/392, 91/394, 404, 405, 409
See application file for complete search history.

(56) References Cited

U.S. PATENT DOCUMENTS 3,805,672 A * 4/1974 Pekrul ..... 91/396

FOREIGN PATENT DOCUMENTS

| | | |
|---|---|---|
| DE | 19600180 | 8/1996 |
| EP | 1 447 571 | 8/2007 |
| FR | 2658872 | 2/1990 |
| FR | 2658872 A * | 8/1991 |
| JP | 57-205403 | 6/1981 |

* cited by examiner

*Primary Examiner* — Thomas E Lazo
(74) *Attorney, Agent, or Firm* — Pearl Cohen Zedek Latzer, LLP

(57) ABSTRACT

A gasket includes a damping buffer for a piston that can be charged with a pressure medium and that can be moved back and forth axially in a cylinder pipe and includes at least one static seal for sealing the cylinder pipe vis-à-vis a cover connected to the face of the cylinder pipe and a dynamic seal having at least one dynamically loaded sealing lip that, during the proper use of the gasket, can be laid against the surface to be sealed of a damping journal that is connected to and axially movable back and forth with the piston and that has at least one flow-guiding connection opening that connects the axial faces of the gasket.

12 Claims, 4 Drawing Sheets

GASKET, COVER WITH GASKET, AND PNEUMATIC CYLINDER WITH COVER AND GASKET

CROSS REFERENCE TO RELATED APPLICATIONS

This is a continuation of U.S. patent application Ser. No. 11/982,158, filed on Nov. 1, 2007 now U.S. Pat. No. 7,866,252, which claims priority to European Patent Application No. 06 022 912.74252 filed Nov. 3, 2006. The subject matter of the aforesaid European Patent Application is hereby incorporated by reference herein.

FIELD OF THE INVENTION

The invention relates to a gasket, to a cover with a gasket, and to a pneumatic cylinder with a cover and a gasket.

BACKGROUND INFORMATION

Gaskets that are used in pneumatic cylinders and that seal face covers vis-à-vis the cylinder pipe of the pneumatic cylinder are generally known, for example, from European Patent No. 1 447 571 B1. The gaskets that seal the face cover vis-à-vis the cylinder pipe are formed by conventional O-rings. On its two faces, the piston has a dynamically loaded seal that serves to mutually seal the spaces that can be charged with a pressure medium. For purposes of end-position damping, a stop element is provided that is at least partially made of iron and that is attached at a certain distance from the face of the piston by means of compression-spring means, said stop element being secured to the piston in a basic position close to the piston by virtue of the magnetic force of at least one permanent magnet and, in an operating position away from the piston, protruding into the adjacent pressure chamber for purposes of end-position damping, whereby an adjustable magnet element arranged on the outside of the cylinder housing is provided to generate a magnetic field that is essentially inverted with respect to the magnetic field of the permanent magnet in order to change the position of the stop element from the basic position into the operating position when the piston passes the magnet element shortly before reaching the end position. The prior-art pneumatic cylinder has numerous individual parts, which is less than satisfactory from a manufacturing-technical and financial standpoint.

SUMMARY OF THE INVENTION

One object of the present invention is to refining a gasket, a cover with a gasket and a pneumatic cylinder with a cover and a gasket in such a way that the individual parts can be manufactured in a simple and cost-effective manner, so that for example, the gasket is multifunctional while having a simple structure. An alternate or additional object of the present invention is to reduce the risk of assembly errors by using a smaller number of parts.

The present invention provides a gasket comprising a damping buffer for a piston that can be charged with a pressure medium and that can be moved back and forth axially in a cylinder pipe and comprising at least one static seal for sealing the cylinder pipe vis-à-vis a cover connected to the face of the cylinder pipe and a dynamic seal having at least one dynamically loaded sealing lip that, during the proper use of the gasket, can be laid against the surface to be sealed of a damping journal and that has at least one flow-guiding connection opening that connects the axial faces of the gasket.

An advantageous aspect of such a gasket is that it encompasses a plurality of functions. The gasket comprises the static seal, the dynamic seal, a dynamic end stop, which also can influence the function of the end-position damping, and also the flow-guiding connection opening that can connect the space charged with pressure inside the cylinder pipe to the relief passage in the cylinder pipe in a flow-guiding manner. In this context, the gasket can be configured in one piece making a transition and made of the same material. As a result, the pneumatic cylinder in which the gasket is arranged and/or the cover to which the gasket is connected may have a simple structure with few parts, which is a noteworthy advantage from a manufacturing-technical and financial standpoint.

The material of the gasket is not the subject matter of the invention, it can be made of any known sealing material and can thus be adapted to the circumstances of a given application case.

The damping buffer, the static seal and the dynamic seal can be configured in one piece, making a transition to each other, and are made of the same material. This combination into one component limits the risk of assembly errors to a minimum.

In order to seal the cover vis-à-vis the cylinder pipe, the static seal can be configured so as to be curved and so that it can be snapped into a congruently shaped undercut in the cover. As a result, the static seal and the cover can be securely connected to each other, forming a pre-assembled unit that is very easy to assemble.

The sealing lip can comprise a first sealing edge, whereby the first sealing edge is laid against the cover so as to seal it when the sealing lip is laid against the damping journal. The sealing edge has to be sealed against the cover so that a sufficiently high pressure for the end-position damping can build up inside the space to be sealed and so that the piston can subsequently move in a damped manner into its end position until it comes to lie against the damping buffer.

The sealing lip can comprise a second sealing edge that is laid against the cover so as to seal it when the sealing lip is laid against the damping journal, whereby the second sealing edge is located upstream from the first sealing edge in the direction of the pressure-charged cylinder pipe. When the piston is moved into the end position, the damping journal touches the sealing lip, thus closing the pressure chamber relative to the piston. The second sealing edge against the cover has the function of blocking off air that could penetrate through the existing venting openings.

The first sealing edge can be surrounded by the second sealing edge on the outside at a radial distance. This makes it possible to achieve the multistage function for moving the piston into its end position. The sealing edges can delimit a C-shaped groove that is axially open towards the piston.

According to another embodiment, the sealing lip can be axially pre-curved in the direction of the piston. Such an embodiment is advantageous in comparison to the previously described embodiment if the end-position damping pressures reach very high values and there is the risk of a gap extrusion. This lip configuration has a pressure-activating effect. The area of the seal and of the cover facing away from the pressure can be configured in such a way that no gap extrusion can occur.

The connection opening can comprise at least one passage on the face of the circumference and, on the other hand, a ring channel on the face that can be connected in a flow-guiding manner to a relief passage in the cylinder pipe. The connection opening inside the gasket can be created concurrently with the production of the gasket, so that there is no longer a need for a laborious, subsequent process step to produce the connection opening. Depending on how the characteristics of the end-position damping are configured, the possibility exists to provide several passages, preferably distributed uniformly along the circumference, all of which open into the ring channel, whereby the ring channel with the relief passage in the cylinder pipe can be connected in a flow-guiding manner.

The faces of the gasket can be connected by a venting opening, whereby the venting opening connects the cylinder pipe and the side of the second sealing edge facing the cylinder pipe in a flow-guiding manner. Owing to such a configuration, the sealing lip is charged by the overpressure that is to be sealed in such a way that the pressure is equalized at both sealing edges and the latter come to lie against the surfaces of the damping journal and cover that are to be sealed, without the risk that they might lift off.

The medium that is sealed can be air.

Moreover, the invention relates to a cover for a pneumatic cylinder that, as described above, is connected to a gasket and, together with it, forms a pre-assembled unit. The undercut in the cover can be formed by a groove that is radially open towards the outside, whereby the curved static seal is arranged in said groove so as to provide a seal.

Moreover, the invention relates to a pneumatic cylinder, comprising at least one face cover with a gasket, each of which is as described above.

BRIEF DESCRIPTION OF THE DRAWINGS

A schematically depicted embodiment will be explained in greater detail below with reference to FIGS. 1, 2 and 3.

DETAILED DESCRIPTION

Figure 1:
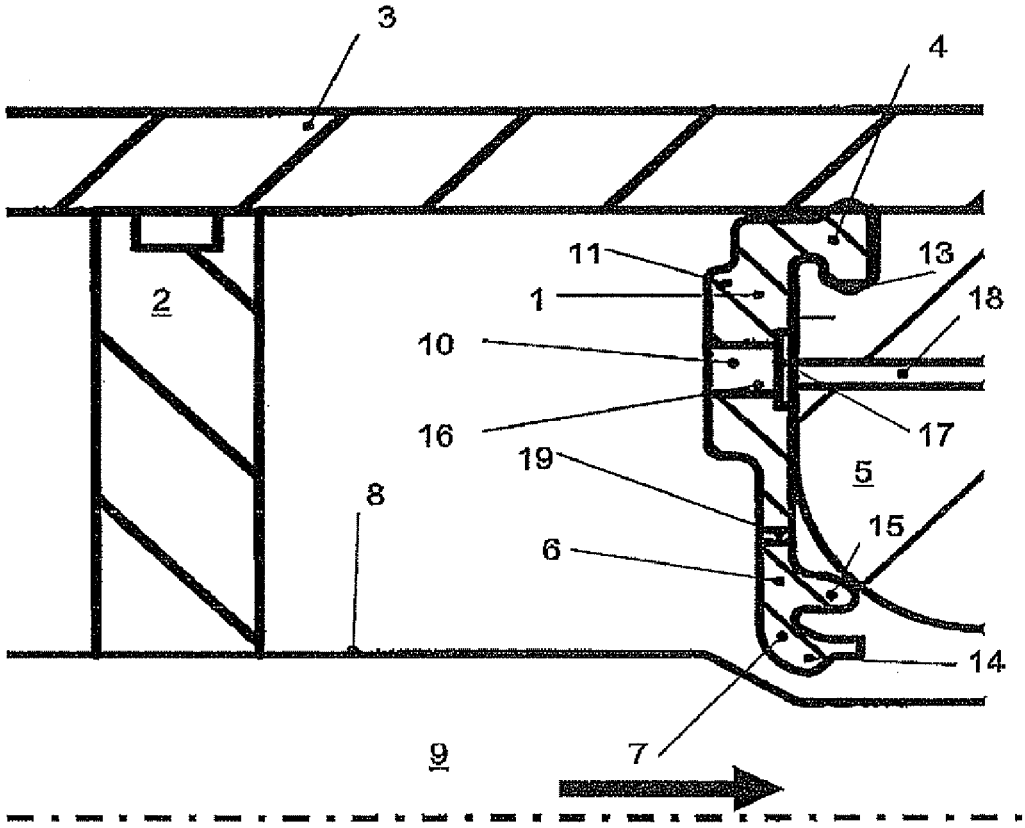
FIGS. 1, 2 and 3 show on embodiment of the gasket according to the invention, the cover according to the invention and the pneumatic cylinder according to the invention in operating states that differ from each other.

FIG. 1 shows a pneumatic cylinder in which the piston 2, upon being charged with the pressure medium, moves in the direction of its end position without being braked.

Figure 2:
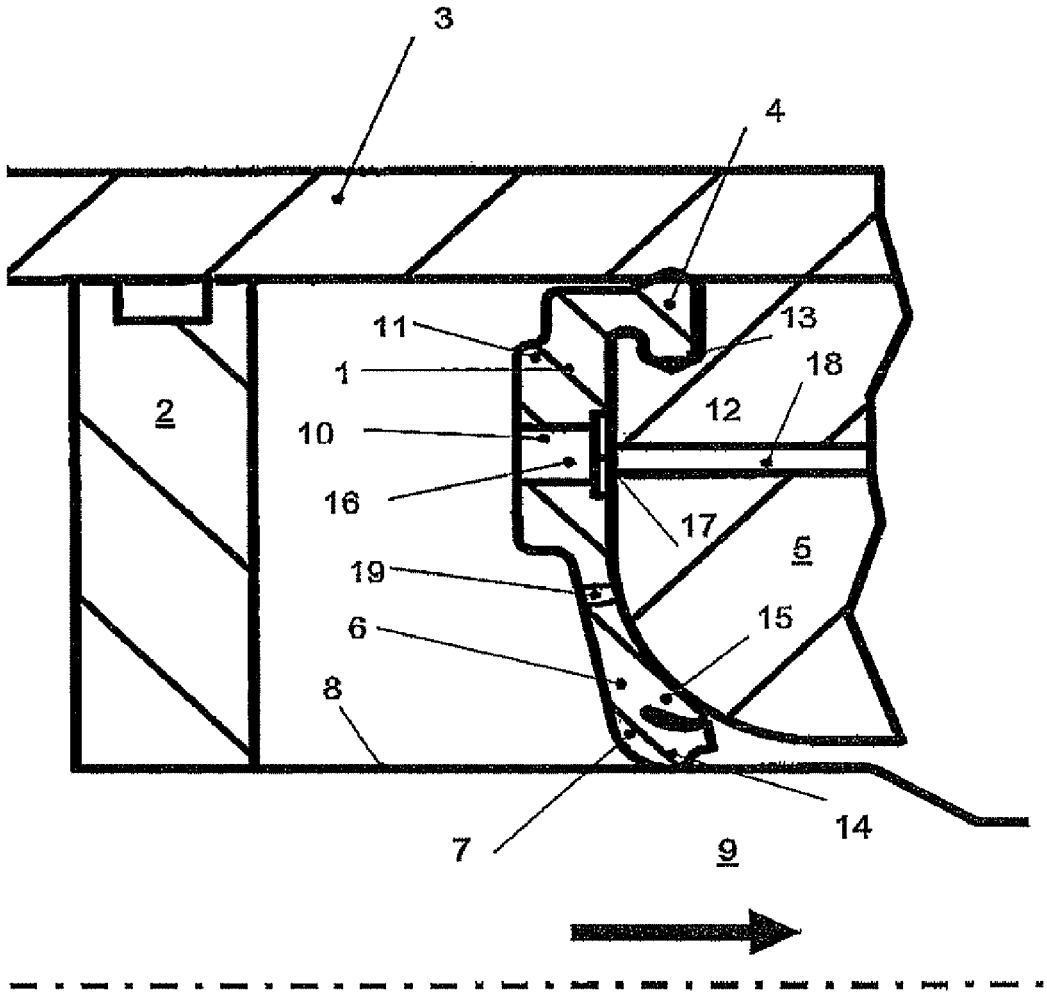

FIG. 2 shows the piston from FIG. 1, whereby the end-position damping has already started and the piston 2 moves towards its end position at a considerably reduced speed.

Figure 3:
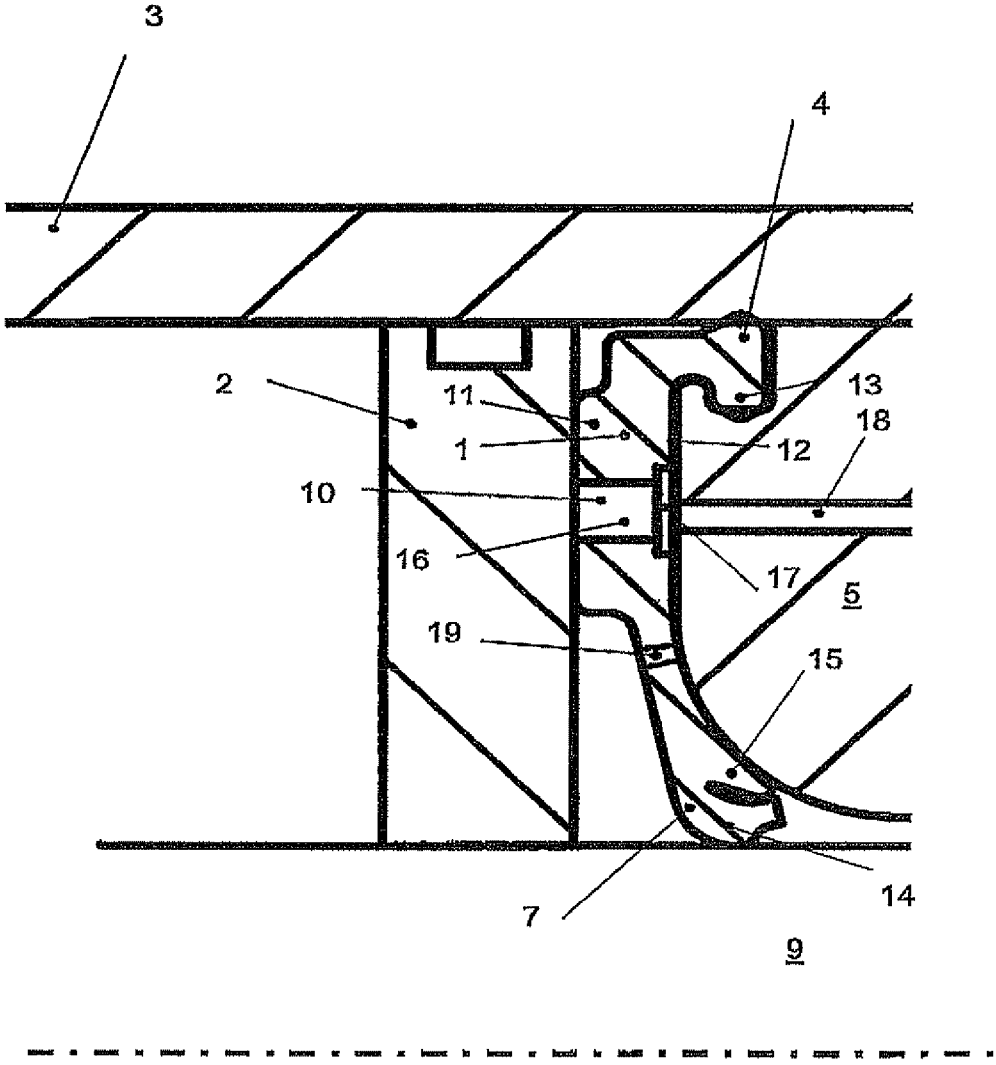

FIG. 3 shows an embodiment of a pneumatic cylinder with the cover according to the invention and with the gasket according to the invention, whereby the piston 2 is in its end position.

FIGS. 1 and 2 schematically show a section of a pneumatic cylinder. Owing to the inventive configuration of the gasket, the pneumatic cylinder consists of just a few parts, which is advantageous from a manufacturing-technical and financial standpoint. This structure with few parts also reduces the risk of assembly errors.

The gasket is multifunctional and comprises a damping buffer 1 that is touched by the piston 2 when it is in its end position (FIG. 3). Moreover, the gasket has a static seal 4 with which the cover 5 arranged on the face of the pneumatic cylinder is sealed vis-à-vis the cylinder pipe 3. In addition, the gasket has a dynamic seal 6 with a dynamically loaded sealing lip 7 that can be laid against the surface 8 of the damping journal 9 to be sealed (FIG. 2 and FIG. 3). Furthermore, the gasket has a flow-guiding connection opening 10 that connects the faces 11, 12 of the gasket, whereby the connection opening 10 in the embodiment shown here consists of a passage 16 that connects the face 11 of the gasket axially facing the piston 2 to a ring channel 17 that is arranged on the face 12 facing the cover 5 and is connected to the relief passage 18 in a flow-guiding manner.

FIG. 1 shows the piston 2 and the damping journal 9 in a position shortly before the end-position damping starts. At the end of the stroke, the damping journal 9 dips into the dynamic seal 6 with its sealing lip 7, thereby closing the remaining pressure space that is to be vented, and said pressure can only still be relieved via the connection opening 10 consisting of the passage 16 and the ring channel 17 and via the relief passage 18 of the pneumatic cylinder.

A divergent embodiment of the connection opening 10 can be, for example, one in which the passage 16, as described above, forms an integral part of the gasket but the ring channel 17 is not located in the gasket but rather in the cover 5. Such an embodiment is considerably more complex than the one described as the advantageous one since it requires machining of the cover 5 in order to create a ring channel or a precise shaping of the cover. The ring channel 17, preferably as an integral part of the gasket, is therefore advantageous since, as a result, the gasket does not have to be positioned at a precise angle in the space reserved for its installation.

In order to quickly vent the cylinder space, there is at least one venting opening 19, whereby preferably several venting openings can be provided that are uniformly distributed along the circumference.

The curved holding section of the static first seal 4 allows it to be snapped on in a positive and sealing manner into a congruently shaped undercut 13 in the cover 5, thereby forming a pre-assembled unit with said cover 5.

The dynamic seal 6 comprises a dynamically loaded sealing lip 7 that has two sealing edges 14, 15, whereby the second sealing edge 15 blocks off the air stream through the venting openings 19 during the movement into the end position. When the sealing lip 7 is laid against the damping journal 9, the second sealing edge 15 lies against the cover 5 so as to seal it, whereby the second sealing edge 15 is located upstream from the first sealing edge 14 in the direction of the pressure-charged cylinder pipe 3.

FIG. 2 shows the piston 2, whereby the end-position damping has already started and the piston 2 moves towards its end position shown in FIG. 3 at a considerably reduced speed.

FIG. 3 shows the piston 2 in its end position lying against the damping buffer 1.

Figure 4:
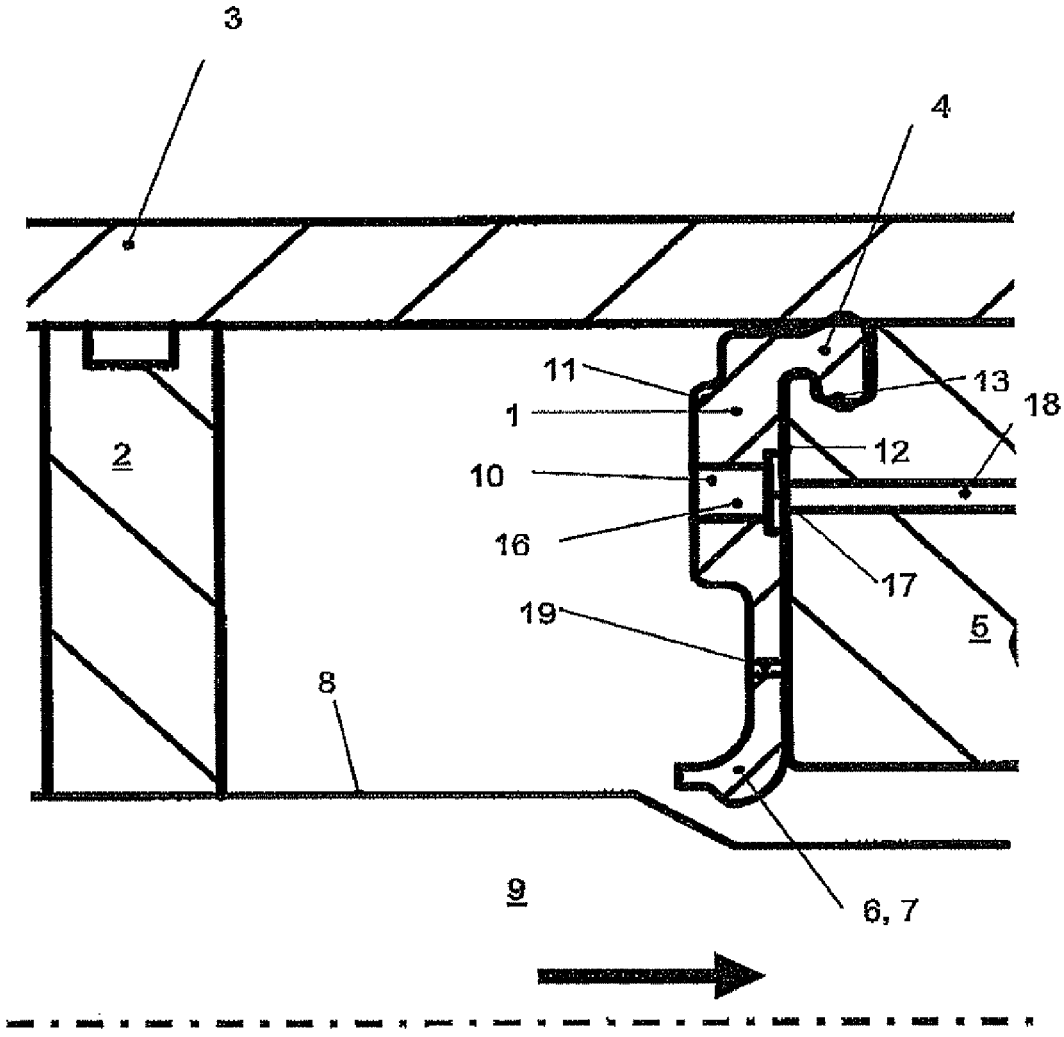
FIG. 4 shows another embodiment.

FIG. 4 shows a divergent embodiment in which the sealing lip 7 is axially pre-curved in the direction of the piston 2.

List of Reference Numerals

1 damping buffer
2 piston
3 cylinder pipe
4 static seal
5 cover
6 dynamic seal
7 dynamic sealing lip
8 surface to be sealed
9 damping journal
10 connection opening
11 left-hand face of the gasket
12 right-hand face of the gasket
13 undercut
14 first sealing edge
15 second sealing edge
16 passage
17 ring channel
18 relief passage
19 venting opening

What is claimed is:

1. A gasket assembly for a pneumatic cylinder comprising:

a cover and a damping buffer for a piston chargeable with a pressure medium and movable back and forth axially in a cylinder pipe;

at least one static seal for sealing the cylinder pipe vis-à-vis a cover connected to a face of the cylinder pipe;

a dynamic seal having at least one dynamically loaded sealing lip, the dynamic seal, during proper use of the gasket, capable of being positioned against a surface to be sealed of a damping journal connected to and axially movable back and forth with the piston, said damping journal having an extended diameter; and at least one flow-guiding connection opening connecting axial faces of the gasket, wherein the static seal is congruently shaped and can snap on the congruent cover in an undercut.

2. The gasket assembly according to claim 1, wherein the damping buffer, the static seal and the dynamic seal are configured in one piece, making a transition to each other, and are made of the same material.

3. The gasket assembly according to claim 1, wherein that the sealing lip comprises a first sealing edge, the first sealing edge being positioned against the cover so as to seal the cover when the sealing lip is positioned against the damping journal.

4. The gasket assembly according to claim 3, wherein the sealing lip comprises a second sealing edge positioned against the cover so as to seal the cover when the sealing lip is positioned against the damping journal, the second sealing edge being located upstream from the first sealing edge in a direction of the pressure-charged cylinder pipe.

5. The gasket assembly according to claim 4, wherein the first sealing edge is surrounded by the second sealing edge on an outside at a radial distance.

6. The gasket assembly according to claim 5, wherein the first and second sealing edges delimit a C-shaped groove that is axially open towards the piston.

7. The gasket assembly according to claim 1, wherein the sealing lip is axially pre-curved in a direction of the piston.

8. The gasket assembly according to claim 1, wherein, on the one hand, the connection opening comprises at least one passage on one of the axial faces and, on the other hand, a ring channel on the other of the axial faces and connectable to a relief passage in the cylinder pipe in a flow-guiding manner.

9. The gasket assembly according to claim 8, wherein the axial faces are connected by a venting opening, the venting opening connecting the cylinder pipe and a side of a sealing edge of the dynamic seal facing the cylinder pipe in a flow-guiding manner.

10. The gasket assembly according to claim 1, wherein a medium to be sealed is air.

11. A preassembled unit comprising: a gasket assembly as recited in claim 1 and a cover for a pneumatic cylinder connected to the gasket.

12. The preassembled unit according to claim 11, wherein the cover has an undercut formed by a groove radially open towards the outside.

* * * * *